United States Patent [19]

Aldridge et al.

[11] Patent Number: 5,031,242

[45] Date of Patent: Jul. 16, 1991

[54] FIREFIGHTER'S TURNOUT APPAREL

[75] Inventors: Donald Aldridge, New Carlisle, Ohio; Billie R. McKenney, Winchester, Ky.

[73] Assignee: Lion Apparel, Dayton, Ohio

[21] Appl. No.: 425,748

[22] Filed: Oct. 23, 1989

[51] Int. Cl.[5] ..... A41D 13/00

[52] U.S. Cl. ..... 2/81; 2/93; 2/227

[58] Field of Search ..... 2/29, 79, 81, 93, 227, 2/231, 232

[56] References Cited

U.S. PATENT DOCUMENTS

| | | | |
|---|---|---|---|
| 1,082,213 | 12/1913 | Robinson | 2/81 |
| 3,534,406 | 10/1970 | Barthlome | 2/2.1 |
| 4,091,464 | 5/1978 | Vykukal | 2/2.1 A |
| 4,091,465 | 5/1978 | Webbon et al. | 2/2.1 A |
| 4,146,933 | 4/1979 | Jenkins et al. | 2/2 |
| 4,509,213 | 4/1985 | Harvey | 2/231 |
| 4,543,670 | 10/1985 | Ehring | 2/85 |
| 4,599,075 | 7/1986 | Nygard | 2/2.1 R |
| 4,608,716 | 9/1986 | Brumfield | 2/2.5 |
| 4,631,753 | 12/1986 | Ehring | 2/85 |
| 4,722,099 | 2/1988 | Kratz | 2/79 |
| 4,782,534 | 11/1988 | Grilliott et al. | 2/81 |
| 4,843,646 | 7/1989 | Grilliott et al. | 2/69 |
| 4,864,655 | 9/1989 | McKenney et al. | 2/81 |

*Primary Examiner*—Thomas B. Will

*Attorney, Agent, or Firm*—Killworth, Gottman, Hagan & Schaeff

[57] ABSTRACT

A firefighter's turnout apparel comprises a coat and a pair of pants, wherein the elbow joint and the knee joint sections are formed to include bellows at the bend of the joints for increased protection, flexion range, and comfort. The bellows interconnect material above and below the joint sections to reduce tightness at the outside of the joint areas and material bunching at the inside of the joint areas, permitting freer flexibility and reduced compression of thermal material. Added material in the bellows which extends around the outer joint area, produces a slight bend in the material at these points results in the tunrout apparel having a more natural and comfortable shape through the joint regions, improving the thermal protection due to the reduced compression. In addition to improved thermal protection, the bellows reduce movement of the cuffs of the apparel to provide better protection of wrist and ankle areas.

12 Claims, 3 Drawing Sheets

FIREFIGHTER'S TURNOUT APPAREL

BACKGROUND OF THE INVENTION

The present invention relates generally to protective clothing for firefighters and, more particularly, to a bellows arrangement for the joint regions of firefighters apparel.

Firefighting is very physically demanding work which must be performed under stressful conditions even in the best of circumstances. It is essential for firefighters to wear clothing which protects them from the hazards of the fire environment, while still allowing freedom of movement, particularly in the elbow and knee joint regions. Firefighter apparel most often consists of a long-sleeved turnout coat and full length turnout pants made of layers including a flame and heat resistant layer, a moisture barrier layer, and a thermal barrier layer. The sleeves and pant legs of prior art turnout apparel provide excellent protection when firefighters are standing upright with their arms straight.

Many duties of a firefighter require flexion in the elbow and knee joint areas, however. Unfortunately, in prior art turnout apparel, tightness is produced across the outside of a joint when the joint is flexed. This tightness compresses the thermal liner and reduces the thermal protection of the clothing in the flexed region. Further, this tightness combined with the material bunching at the inside of the joint reduces the range of flexion of the joint. Additionally, the force required to bend the joint is increased, while complete flexion of the joint is impaired. Finally, there is a relatively high amount of cuff travel when joints are flexed, increasing the risk of exposure to fire hazards.

One method for decreasing tightness and bunching of material at the inside of the joint regions is disclosed in U.S. Pat. No. 4,843,646. The disclosed method involves providing thinner material at the joint flexion regions. However, providing thinner material necessarily decreases the thermal protection for the firefighter at his or her joint regions when the firefighter is in a variety of working positions, increasing the firefighter's risk of exposure to fire hazards.

Accordingly, there is a need for improved turnout apparel which facilitates joint flexion by substantially reducing the tightness on the outside of the flexed joint, compression of the thermal barrier, and the amount of sleeve and/or pant cuff travel, without decreasing the thermal protection provided to the firefighter at the joint regions. Improvements in the design of firefighter turnout apparel provide more comfort and permit freer mobility while requiring less work to bend joints, providing advances in the art and, more importantly, better protection for firefighters.

SUMMARY OF THE INVENTION

The improvements of the present invention solve the problems existing in prior art turnout apparel by providing bellows at the joint regions of turnout apparel. The bellows add a more natural shape to the joint regions by producing a slight bend in these regions which permit joints to be flexed without substantially tightening the material across the outside of the joints or bunching up the material at the inside of the joints, and also without reducing the thermal protection barrier in those regions.

In the preferred embodiment of this invention, generally elliptically shaped bellows in the joint regions are constructed with extra material in all layers of the turnout apparel thereby substantially reducing compression in all layers when the joints are flexed. A generally elliptically shaped patch may then be attached as the outside layer of the generally elliptically shaped bellows to extend the wear life and reduce compression burns. The bellows extend from seam to seam across the outside of the joint, covering one half of the joint area. The bellows are wider at the middle to eliminate pulling and tightness, and narrower at the seams to reduce material bunching. The extra material provided by the bellows of the present invention reduces the tightness on the outside of the joints, thereby reducing the compression of all layers of material in the turnout apparel.

In accordance with one aspect of the present invention, a firefighter's turnout coat comprises a body portion cut to define armholes which accommodate full length sleeves. Typically, the sleeves of a turnout coat are constructed of two pieces of material; the first piece forming the front of the sleeve and extending from shoulder to cuff along the inside of the elbow joint, and the second piece forming the back of the sleeve and extending from shoulder to cuff along the outside of the elbow joint.

This two-piece construction facilitates the addition of the bellows to the sleeves of the turnout coat. The back of the sleeve is cut into two approximately equal pieces across the middle of the sleeve, then each piece is trimmed to the proper length and sewn to the generally elliptical patch forming the outermost layer of the bellows. Similar alterations are made to all layers of the sleeve. Preferably, the dimensions of the elbow bellows range from approximately 3 inches wide at the ends to approximately 6 inches wide in the middle over a length of approximately 10 inches. The front sleeve piece and resulting composite back sleeve piece are joined together by seams that start at the top of the shoulder and under the arm and extend the length of the sleeve to the cuff.

In accordance with a second aspect of the present invention, firefighter's turnout pants comprise a waist portion and two full length leg portions. Typically, each leg of the turnout pants is constructed from one piece of material that is rolled into a cylindrical shape. For the invention, this cylinder of material is cut into two halves at the knee to accommodate a knee joint bellows, which may again be covered with a generally elliptically shaped patch to extend the wear life and reduce compression burns.

As with the elbow bellows, the knee bellows extend halfway around the leg across the front or outside of the knee, producing a slight bend in the legs of the turnout pants at the knee to reduce material tightness when the knee is flexed. Narrow generally rectangular bands can be added to the bellows at the knee joints to extend across the back or inside of the knee joint, so the bellows and the generally rectangular portion together form a band that encircles the entire knee joint. Alternately, the pant legs can be constructed of a front section and a back section similar to the sleeve. For this construction, the rectangular bands are not needed; however, the pant legs require both an inseam and an outseam.

Preferably, the bellows covering the knee joints are approximately 4 inches wide at the narrow ends and expand to approximately 8 inches at their widest middle sections. The narrow generally rectangular band portion is about 13 inches long, resulting in a total length of approximately 25 inches for the bellows and the rectangular portions combined. For this fixed size knee bellows, the upper and lower leg sections are altered for varying leg lengths. Alternately, it may be desirable to provide varying leg lengths by varying the size of the bellowed band.

It is an object of the present invention to provide improved firefighter turnout apparel to facilitate the ability of firefighters to flex their joints while wearing the turnout apparel; to provide an improved firefighter turnout coat wherein flexion of the wearer's elbows is facilitated by providing enlarged width bellows for interconnecting the lower half of a sleeve to the upper half of a sleeve in a more comfortable and flexible manner than with conventional turnout coats; to provide improved firefighter turnout pants wherein flexion of the wearer's knees is facilitated by providing an enlarged width bellow for interconnecting the lower pant leg with the upper pant leg in a more comfortable and flexible manner than with conventional turnout pants; and, to provide improved firefighter turnout apparel wherein additional material is provided by bellows located within the joint portions of the apparel to increase the fullness and flexibility of the outer joint regions.

Other objects and advantages of the invention will be apparent from the following description, the accompanying drawings, and the appended claims.

DETAILED DESCRIPTION OF THE INVENTION

Figure 1A:
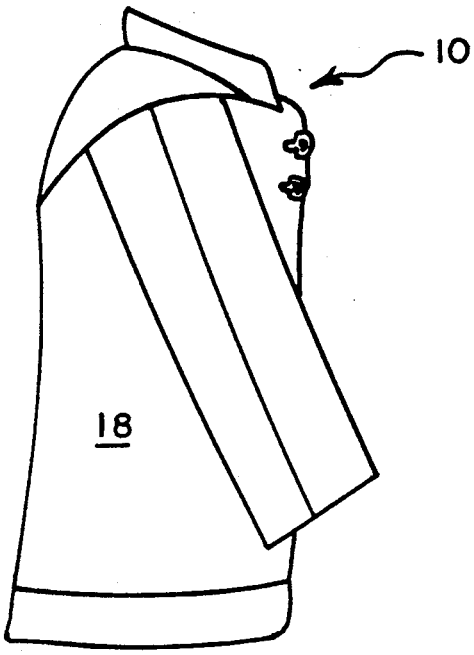
FIG. 1A PRIOR ART
FIGS. 1A and 1B are side views of prior art firefighter turnout apparel including a turnout coat and a pair of turnout pants, respectively.
Figure 1B:
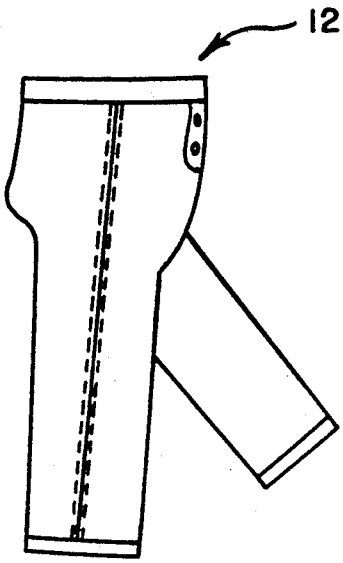
FIG. 1B PRIOR ART
Figure 2:
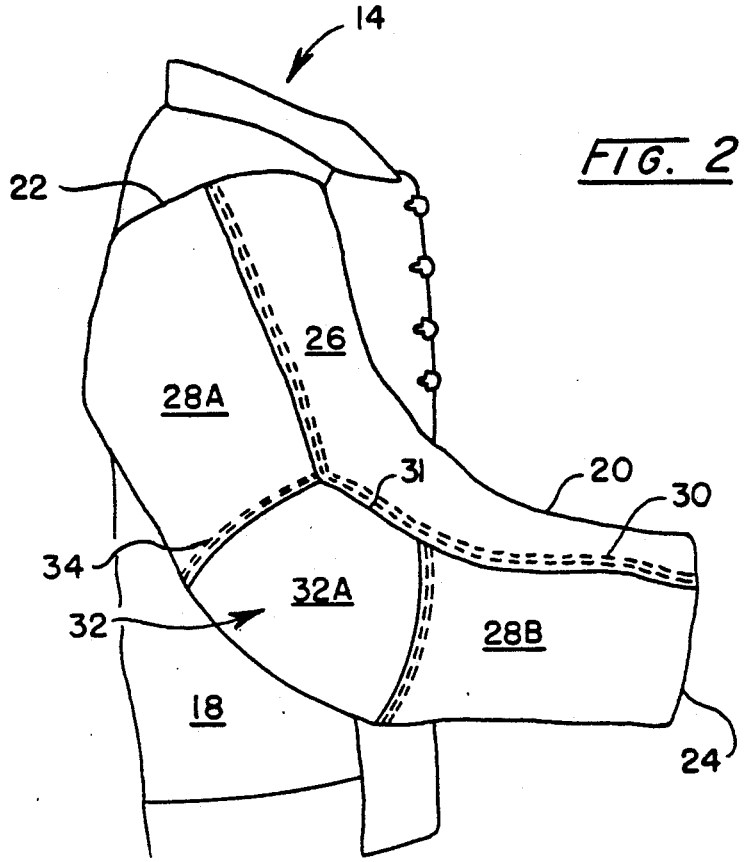
FIG. 2 is a side view of a firefighter's turnout coat with sleeves in accordance with the present invention.
Figure 5:
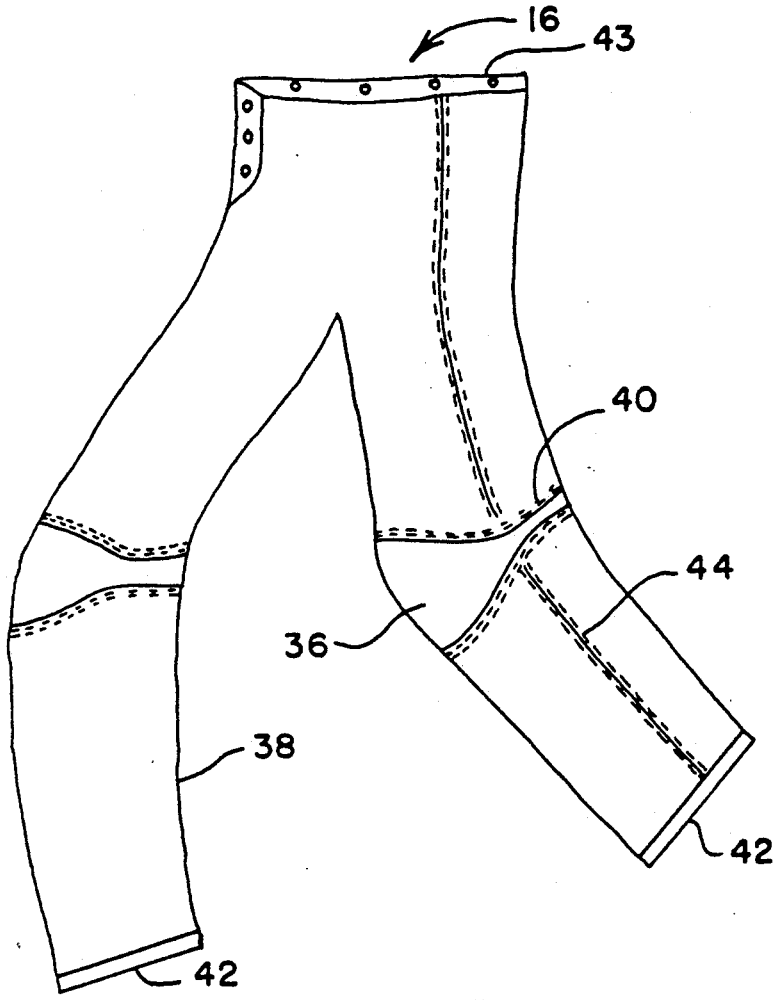
FIG. 5 is a side view of a pair of firefighter's turnout pants with pant legs in accordance with the present invention.

Referring now to the drawings, FIG. 1A and FIG. 1B show prior art firefighter's turnout apparel 10 and 12. FIG. 1A is a side view of a prior art firefighter's turnout coat 10 which provides excellent protection when the wearing firefighter's arms are straight, and FIG. 1B is a side view of a prior art pair of firefighter's turnout pants which provides excellent protection when the wearing firefighter's legs are straight. FIG. 2 is a side view of a firefighter's turnout coat 14 in accordance with the present invention. It is to be understood that the other side of the coat is substantially a mirror image of the side shown with the exception that the other side has fasteners which cooperate with the fasteners on the side shown. Similarly, FIG. 5 is a side view of a pair of firefighter's turnout pants 16 in accordance with the present invention. The present invention has provided improvements in firefighter turnout apparel 14 and 16 which permit greater joint flexibility and protection during joint flexing, while decreasing the effort needed to flex joints when wearing turnout apparel 14 and 16. The improvements of the present invention comprise bellows provided at the joint sections of the turnout apparel, which bellows are pictured in FIG. 3 and FIG. 6.

Referring now to FIG. 2, the firefighter's turnout coat 14 has a body portion 18 with an attached sleeve 20. The sleeve 20 begins at the shoulder portion 22 of the turnout coat 14 and extends, to the cuff 24. The sleeve 20 has a front length 26 extending from shoulder 22 to cuff 24 along the top or inside of the elbow joint. The front length 26 is attached to a back length 28 extending from shoulder 22 to cuff 24 along the back or outside of the elbow joint via stitching 30 along both sides of the sleeve 20.

In a preferred embodiment of this invention, the two-piece construction of the sleeve 20 permits incorporation of an elbow bellows 32 of the present invention into the sleeve 20. The elbow bellows 32 can be incorporated into the sleeve 20 by cutting the back length 28 into an upper section 28A and a lower section 28B and then sewing the bellows 32 between the upper and lower sections 28A, 28B to add extra elbow room to the sleeve 20.

The elbow bellows 32 of the present invention is embedded in the sleeve 20 and is constructed with a band of material in all layers of the turnout coat 14. Of course, the inner layers of material forming the bellows 32 in the sleeve 20 are not visible in the drawings. However, a generally elliptically shaped patch 32A which is visible in FIG. 2, preferably of leather to extend the wear life and reduce compression burns, forms the outer or top layer of the bellows 32 on the outside of the elbow. Each inner layer is constructed of the appropriate material for that layer and is also of the generally elliptical shape of the patch 32A.

Figure 3:
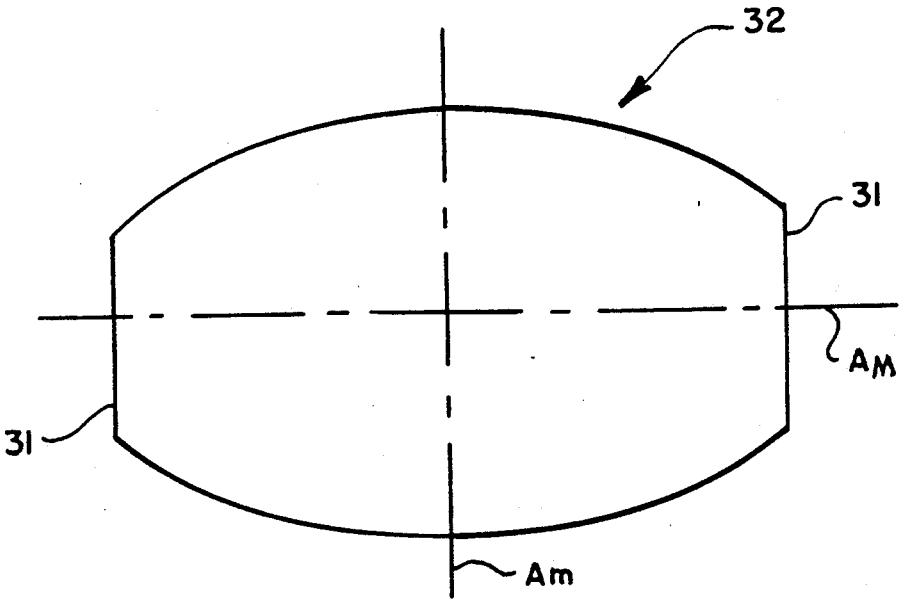
FIG. 3 is an enlarged view of the elbow bellows of the firefighter's turnout coat shown in FIG. 2.

The generally elliptical shape of the bellows 32 is shown in FIG. 3. The elbow bellows 32 generally extends from seam to seam across the back or outside of the elbow joint. The bellows 32 comprises a series of generally flat pieces of material shaped as shown in FIG. 3 and is not pleated but provides extra material at the middle to eliminate pulling and tightness across the back of the elbow joint when the elbow is flexed. Although the added material provided by the generally elliptically shaped bellows 32 becomes narrower at the seams to reduce bunching of the material at the front of the elbow when the elbow is flexed, the thermal protection is not reduced. The bellows 32 is positioned such that its minor axis $A_m$ follows the contours of the elbow, and its major axis $A_m$ extends generally around the elbow such that narrow ends 31 of the generally elliptical bellows 32 are aligned with the stitching 30 on the inside and outside of the sleeves, see FIGS. 2 and 3. The bellows 32 has a preferred dimension range of 3 inches wide at the ends 31, expanding to 6 inches wide at the middle. The preferred length of the generally elliptical elbow bellows 32 is 10 inches. The design of the present invention then results in a slight natural bend in the sleeve 20, similar to the contours of an arm and elbow, thereby providing more comfort and less effort when the elbow is flexed.

Figure 4:
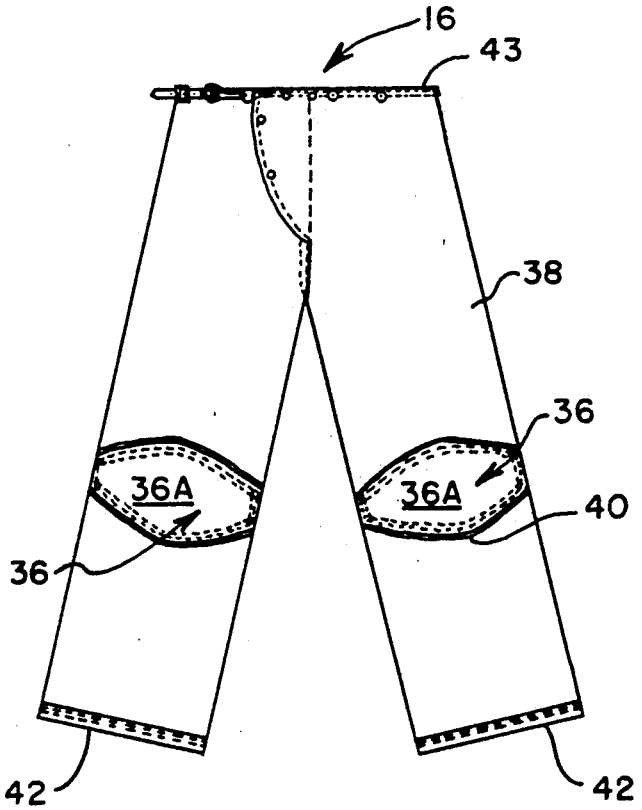
FIG. 4 is a front view of a pair of firefighter's turnout pants with pant legs in accordance with the present invention.

FIG. 4 represents another embodiment of the present invention wherein a knee bellows 36 is incorporated into the knee joint sections of turnout pants 16. Generally elliptical patches 36A, similar to the elliptical elbow patches 32A of FIG. 2, cover the knee bellows 36 on each knee of the turnout pants 16. Pant legs 38 are cut at the knee to allow incorporation of the knee bellows 36 at the knee joint sections by stitching as indicated by reference number 40.

Firefighter turnout pant legs 38 may each be constructed of a single piece of material formed as a cylinder and stitched up the outside length or outseam of the leg from the pant leg cuffs 42 to the waist 43 as indicated by the stitching 44 in FIG. 5. However, the pant leg length or inseam needs to be adjustable to accommodate firefighters of all heights and leg lengths. Consequently for a one-piece cylindrical pant leg design, the bellows 36 at the knee joints can be sized to adjust the inseam length of the pant legs 38. Such variable sizing is indicated by the dashed lines in FIG. 6.

Figure 6:
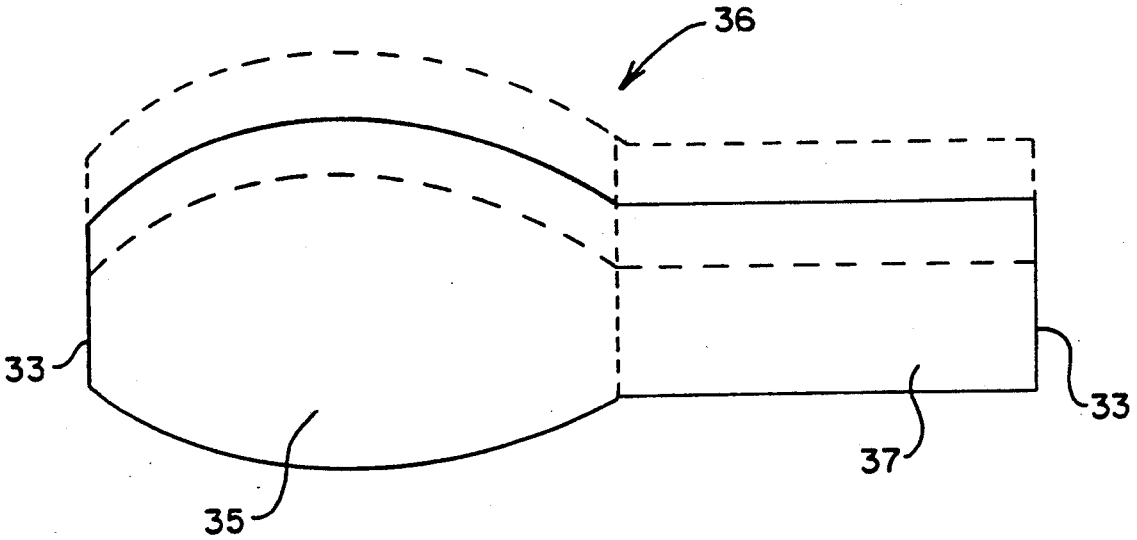
FIG. 6 is an enlarged view of one embodiment of the knee bellows of the firefighter's turnout pants shown in FIGS. 4 and 5.

A knee bellows 36 which includes a narrow generally rectangular portion 37 in addition to a generally elliptical portion 35 is shown in FIG. 6. The generally elliptical portion 35, covers the front or outside of the knee. The narrow generally rectangular portion 37 continues across the back of the knee joint, as shown best shown in FIG. 5. The addition of the narrow generally rectangular portion 37 allows for adjustment of the pant leg 38 length when the pant leg 38 is constructed with a single seam. Thus, by increasing or decreasing the generally elliptically shaped portion 35 and/or the generally rectangular portion 37, the pant leg 38 length can be adjusted. Alternatively, the pant leg 38 material could be cut at the knee area to shorten or lengthen the pant leg 38, thereby allowing for one size of bellows 36 to be incorporated into any length turnout pants 16. It would appear that the alternative method is preferred since it is more desirable to provide only one size of bellows 36 usable with any length turnout pants 16.

Preferably, the knee bellows 36 is approximately 4 inches wide at the ends 33. The generally elliptical portion 35 is approximately 12 inches long and expands to 8 inches in width at its widest middle point to produce a slight natural bend in the turnout pant leg 38, similar to the natural bend of a knee joint. The narrow generally rectangular portion 37 of the bellows 36 remains at a constant width of approximately 3 inches and has an approximate length of 13 inches, resulting in a total length of approximately 25 inches for the generally elliptical portion 35 and the narrow generally rectangular portion 37 combined.

Another possible turnout pant leg 38 construction would be a two-seam or inseam and outseam construction, similar to the two-piece sleeve 20 construction. In a two-piece pant leg 38 design, the bellows 36 would be generally elliptically shaped as in the turnout coat sleeve bellows 32, thus eliminating the need for the additional narrow generally rectangular portion 37 of FIG. 6 as indicated by the dotted line. In such a design, the pant leg 38 is formed as a continuous back section with a two-piece front section with the length being adjusted by appropriately cutting upper and lower front leg sections before inserting the bellows 36.

The bellows of the present invention provide for improved firefighter turnout apparel. The added material at the joint areas of the apparel reduces tightness and compression of the thermal liner in firefighter turnout apparel, while at the same time not reducing the thermal protection provided at the joint regions. The present invention thereby results in improved thermal protection of the clothing in the flexed regions. Additionally, the slight natural bend of the apparel in the joint areas caused by the added bellows material reduces bunching of the material at the inside of the joint, thereby increasing the range of flexion of the joint and reducing dangerous cuff travel during flexion, but does not reduce the thermal barrier.

Having described the invention in detail and by reference to preferred embodiments thereof, it will be apparent that modifications and variations are possible without departing from the scope of the invention which is defined in the appended claims.

What is claimed is:

1. Firefighter turnout apparel comprising:

an upper body portion cut to define armholes and having shoulder sections;

full length sleeves extending the length of an arm from the shoulder sections of the upper body portion to a cuff, each sleeve having a front length and a back length wherein the back length is cut to define an upper section and a lower section with an elbow joint area therebetween;

first bellows means being generally elliptical in shape and having a major axis extending generally around the back of the elbow joint area for interconnecting the upper back section of each sleeve with the lower back section of each sleeve, the first bellows means providing increase protection for the wearer of the turnout apparel and increased flexion range for the elbow joint areas of the turnout apparel;

a lower body portion including full length pant legs, each pant leg having a knee joint area, and further having an upper leg section extending above the knee joint area and a lower leg section extending below the knee joint area; and second bellows means for interconnecting the upper leg section of each pant leg with the lower leg section of each pant leg, the second bellows means comprising at least first generally elliptically shaped portions having major axes which extend generally around front portions of the knee joint areas providing increased protection for the wearer of the turnout apparel and increase flexion range for the knee joint areas of the turnout apparel.

2. Firefighter turnout apparel as claimed in claim 1 wherein the first bellows means are situated to supply increased thermal protection and flexion range to the elbow joint areas of the turnout apparel by interconnecting the upper back sleeve section and the lower back sleeve section of each sleeve to provide extra material therebetween producing a slight natural bend in the turnout apparel at the elbow joint area sand thereby reducing tightness and compression of the elbow joint areas.

3. Firefighter turnout apparel as claimed in claim 1 wherein each of the knee joint areas further comprise a back portion, and the second bellows means are situated to supply increased thermal protection and flexion range to the knee joint areas of the turnout apparel by interconnecting the upper leg section and the lower leg section to provide extra material int he front portions of the knee areas thereby producing a slight natural bend in the turnout apparel at the knee joint areas and reducing tightness and compression of the knee joint areas.

4. Firefighter's turnout apparel as claimed in claim 2 wherein the first bellows means are covered by generally elliptically shaped patches.

5. Firefighter's turnout apparel as claimed in claim 4 wherein the patches are constructed of leather to extend the wear life and reduce compression burns.

6. Firefighter's turnout apparel as claimed in claim 1 wherein the second bellows means each comprise a first half and a second half, the first half of each second bellows means having a generally elliptical shape and extending across a front knee joint area, the second half of each second bellows means having a narrow generally rectangular shape and extending across a back knee joint area, whereby the second bellows means extend wholly around the knee joining areas.

7. Firefighter's turnout apparel as claimed in claim 3 wherein the second bellows means are covered by patches constructed of leather to extend the wear life and reduce compression burns.

8. Firefighter's turnout apparel as claimed in claim 4 wherein the first bellows means is approximately 3 inches in width at outside ends thereof, expanding generally elliptically to an approximate width of 6 inches at a widest center point thereof, the first bellows means having an approximate length dimension of 10 inches.

9. Firefighter's turnout apparel as claimed in claim 6 wherein the second bellows means is approximately 4 inches in width throughout its narrow generally rectangular portion at the back knee joining area and the elliptical portion at the front knee joint area is approximately 4 inches in width at its outer ends expanding to a maximum width of approximately 8 inches, said second bellows means having an elliptical length of approximately 12 inches and a rectangular length of approximately 13 inches resulting in said second bellows means having a total length of approximately 25 inches.

10. A firefighter's turnout coat comprising:

a body portion cut to define armholes and shoulder sections full length sleeves coordinated with the armholes and shoulder sections, each sleeve having a front length and a back length, said back length being cut to define an upper section and a lower section with an elbow joint area being defined therebetween; and bellows means for interconnecting the upper back section of each sleeve with the lower back section of each sleeve, the bellows means being generally elliptically shaped and having a major axis extending generally around the back of the elbow joint area, whereby firefighters wearing the turnout coat are provided with increased protection and increased flexion range for the elbow joint areas of the turnout coat.

11. A pair of firefighter's turnout pants comprising:

a pair of full length pant legs, each pant leg having a front knee joint area and a back knee joint area, and further having an upper leg section and a lower leg section; and bellows means for interconnecting the upper leg section of each pant leg with the lower leg section of each pant leg, the bellows means comprising at least a first generally elliptically shaped portion having a major axis which extends generally around the front knee joint area, whereby firefighter's wearing the turnout pants are provided with increased protection and increased flexion range for the knee joint areas of the turnout pants.

12. A pair of firefighter's turnout pants as claimed in claim 11 wherein the bellows means further comprises a second generally rectangular shaped portion which extends across the back knee joint area of each pant leg, thereby creating bellows means which extend entirely around the knee joint areas of said turnout pants.

* * * * *

UNITED STATES PATENT AND TRADEMARK OFFICE

CERTIFICATE OF CORRECTION

PATENT NO. : 5,031,242

DATED : July 16, 1991

INVENTOR(S) : Donald Aldridge et al

It is certified that error appears in the above-identified patent and that said Letters Patent is hereby corrected as shown below:

| | |
|---|---|
| Col. 6, line 25, | change "increase protection" to --increased protection--. |
| Col. 6, line 50, | change "area sand" to --areas and--. |
| Col. 6, line 59, | change "int he" to --in the--. |
| Col. 7, line 9, | change "knee joining areas" to --knee joint areas--. |
| Col. 7, line 24, | change "knee joining area" to --knee joint area--. |

Signed and Sealed this

Sixth Day of April, 1993

*Attest:*

STEPHEN G. KUNIN

*Attesting Officer*

*Acting Commissioner of Patents and Trademarks*